US009771688B2

(12) United States Patent
Pang et al.

(10) Patent No.: US 9,771,688 B2
(45) Date of Patent: Sep. 26, 2017

(54) OIL, GREASE, AND MOISTURE RESISTANT PAPERBOARD

(71) Applicant: WestRock MWV, LLC, Richmond, VA (US)

(72) Inventors: Jiebin Pang, Glen Allen, VA (US); Natasha Gandia Melton, Richmond, VA (US); Sergio A. Giuste, Beaumont, TX (US)

(73) Assignee: WestRock MWV, LLC, Norcross, GA (US)

( * ) Notice: Subject to any disclaimer, the term of this patent is extended or adjusted under 35 U.S.C. 154(b) by 0 days.

(21) Appl. No.: 15/017,735

(22) Filed: Feb. 8, 2016

(65) Prior Publication Data

US 2016/0230343 A1 Aug. 11, 2016

Related U.S. Application Data

(60) Provisional application No. 62/114,716, filed on Feb. 11, 2015, provisional application No. 62/164,128, filed on May 20, 2015.

(51) Int. Cl.

| | |
|---|---|
| ***D21H 19/82*** | (2006.01) |
| ***D21H 19/40*** | (2006.01) |
| ***D21H 19/38*** | (2006.01) |
| ***D21H 19/58*** | (2006.01) |
| ***D21H 23/72*** | (2006.01) |
| ***D21H 23/34*** | (2006.01) |
| ***D21H 23/32*** | (2006.01) |
| ***D21H 23/50*** | (2006.01) |
| ***D21H 23/48*** | (2006.01) |
| ***D21H 23/56*** | (2006.01) |
| ***D21H 19/44*** | (2006.01) |
| ***D21H 19/60*** | (2006.01) |
| ***D21H 21/16*** | (2006.01) |

(52) U.S. Cl.

CPC ..... *D21H 19/822* (2013.01); *D21H 19/385* (2013.01); *D21H 19/40* (2013.01); *D21H 19/44* (2013.01); *D21H 19/58* (2013.01); *D21H 19/60* (2013.01); *D21H 19/82* (2013.01); *D21H 21/16* (2013.01); *D21H 23/32* (2013.01); *D21H 23/34* (2013.01); *D21H 23/48* (2013.01); *D21H 23/50* (2013.01); *D21H 23/56* (2013.01); *D21H 23/72* (2013.01)

(58) Field of Classification Search

CPC .... D21H 19/822; D21H 19/40; D21H 19/385; D21H 19/58; D21H 23/72; D21H 23/34; D21H 23/32; D21H 23/50; D21H 23/48

USPC ..... 428/536

See application file for complete search history.

(56) References Cited

U.S. PATENT DOCUMENTS

| | | | | | |
|---|---|---|---|---|---|
| 5,776,619 | A * | 7/1998 | Shanton | A47G 19/03 | 427/326 |
| 5,981,011 | A * | 11/1999 | Overcash | D21H 19/16 | 428/34.2 |
| 6,074,733 | A * | 6/2000 | Falat | B65D 65/42 | 428/219 |
| 6,740,373 | B1 * | 5/2004 | Swoboda | B32B 29/06 | 229/5.81 |
| 2004/0121080 | A1 * | 6/2004 | Urscheler | B05D 1/305 | 427/420 |

FOREIGN PATENT DOCUMENTS

| | | | |
|---|---|---|---|
| WO | WO2006/007239 | * | 1/2006 |
| WO | WO2013/189550 | * | 12/2013 |
| WO | WO2014/006269 | * | 1/2014 |

* cited by examiner

*Primary Examiner* — Leszek Kiliman

(74) *Attorney, Agent, or Firm* — Westrock Intellectual Property Group

(57) ABSTRACT

A coated paperboard is disclosed which includes a base coat and top coat containing substantially no fluorochemical or wax, exhibiting good resistance to oil and grease, no tendency toward blocking, and being fully repulpable. Improved moisture resistance is also exhibited.

23 Claims, 5 Drawing Sheets

OIL, GREASE, AND MOISTURE RESISTANT PAPERBOARD

REFERENCE TO RELATED APPLICATIONS

This application claims the benefit of priority under 35 U.S.C. §119(e) of U. S. provisional applications Ser. No. 62/114,716 filed on Feb. 11, 2015, and Ser. No. 62/164,128 filed on May 20, 2015, which are hereby incorporated by reference in their respective entireties.

This disclosure relates to a method to treat paperboard with aqueous coatings to obtaining surprisingly good resistance to oil and grease penetration. The paperboard also has good moisture resistance. The treated paperboard is fully repulpable and does not have any tendency toward blocking.

BACKGROUND OF THE INVENTION

1. Field of the Invention

This disclosure relates to paperboard substrates having good oil and grease resistance, yet with full recyclability and without a tendency toward blocking.

2. Description of the Related Art

Oil and grease resistance is one of the top needs for paperboard packages in food and food service industries. Several technologies including specialty chemical (wax, fluorochemicals, starch, polyvinyl alcohol (PVOH), sodium alginate, etc.) treatment, polymer extrusion coating (polyethylene, etc.) have been employed to provide oil and grease resistance of paperboard packaging. However, the paper or paperboard treated with wax or coated with polyethylene, which is currently used in oil and grease resistant packaging, has difficulties in repulping and is not as easily recyclable as conventional paper or paperboard. Paper or paperboard treated with specialty chemicals such as fluorochemicals has potential health, safety and environmental concerns, and scientists have called for a stop to non-essential use of fluorochemicals in common consumer products including packaging materials.

Thus, there is still a critical need for oil and grease resistant paperboard that is 1) high performance, 2) without environmental or safety concerns, 3) recyclable, and 4) low cost. Aqueous coating is one of the promising solutions to achieve these goals. However, blocking (the tendency of layers in a roll of paperboard to stick to one another) is a challenging technical hurdle in production and converting processes for aqueous barrier coated paperboard, and blocking is also a major technical hurdle for on-machine application of aqueous barrier coatings. Furthermore, most aqueous barrier coatings are not fully repulpable. The current invention addresses the problems discussed above.

SUMMARY OF THE INVENTION

The general purpose of the invention is to coat the 'barrier' side of a paperboard with two layers of aqueous coating, the two layers either being the same coating formulation or two different formulations. The two layers of coating show a synergistic effect on barrier performance. The coating can either be applied on a paper machine or by an off-line coater. Paperboard coated according to the invention provides high resistance to oil and grease, does not have any tendency to block, is compliant to safety and environmental regulations, is fully repulpable, and can be produced at a low cost.

In one embodiment coated paperboard is disclosed which includes a paperboard substrate having a first side and a second side; a base coat in contact with the first side, the base coat comprising binder and pigment, the base coat containing substantially no fluorochemical or wax; a top coat in contact with the base coat, the top coat comprising binder and pigment, the top coat containing substantially no fluorochemical or wax; and wherein the coated paperboard has a 3M kit test value of at least 10.

In another embodiment, a coated paperboard is disclosed which includes a paperboard substrate having a first side and a second side; a base coat in contact with the first side, the base coat having a coat weight from 5 to 12 lbs per 3000 $ft^2$ and comprising binder and pigment , the base coat containing substantially no fluorochemical or wax; a top coat in contact with the base coat, the top coat having a coat weight from 2 to 9 lbs per 3000 $ft^2$ and comprising binder and pigment , the top coat containing substantially no fluorochemical or wax; and wherein the coated paperboard has a 3M Kit test value of at least 10, is at least 99% repulpable, and has no tendency toward blocking after being held for 24 hours at 50° C. at a pressure of 100 psi.

In another embodiment, a combination of binders is used to provide improved moisture resistance of the coated paperboard.

DETAILED DESCRIPTION OF THE INVENTION

Figure 1:
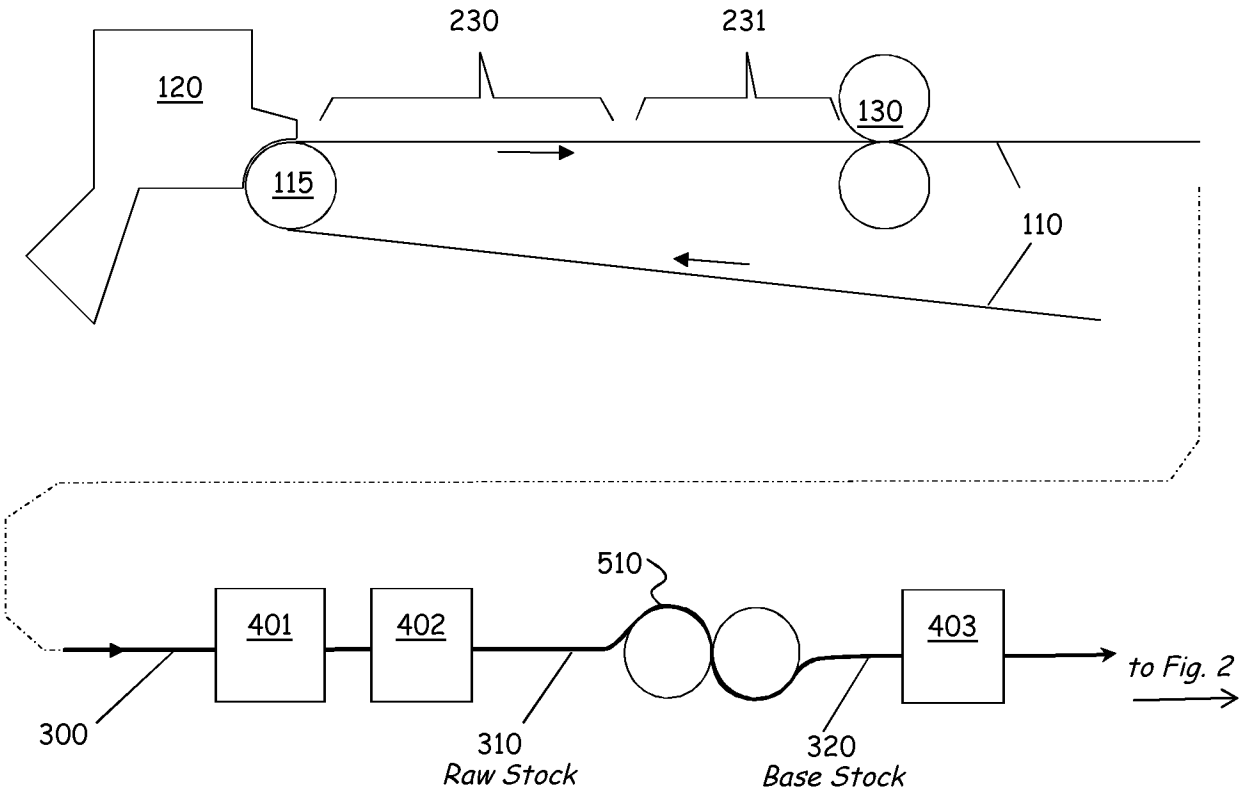
FIG. 1 illustrates a method for producing a base stock on a paperboard machine.
Figure 2:
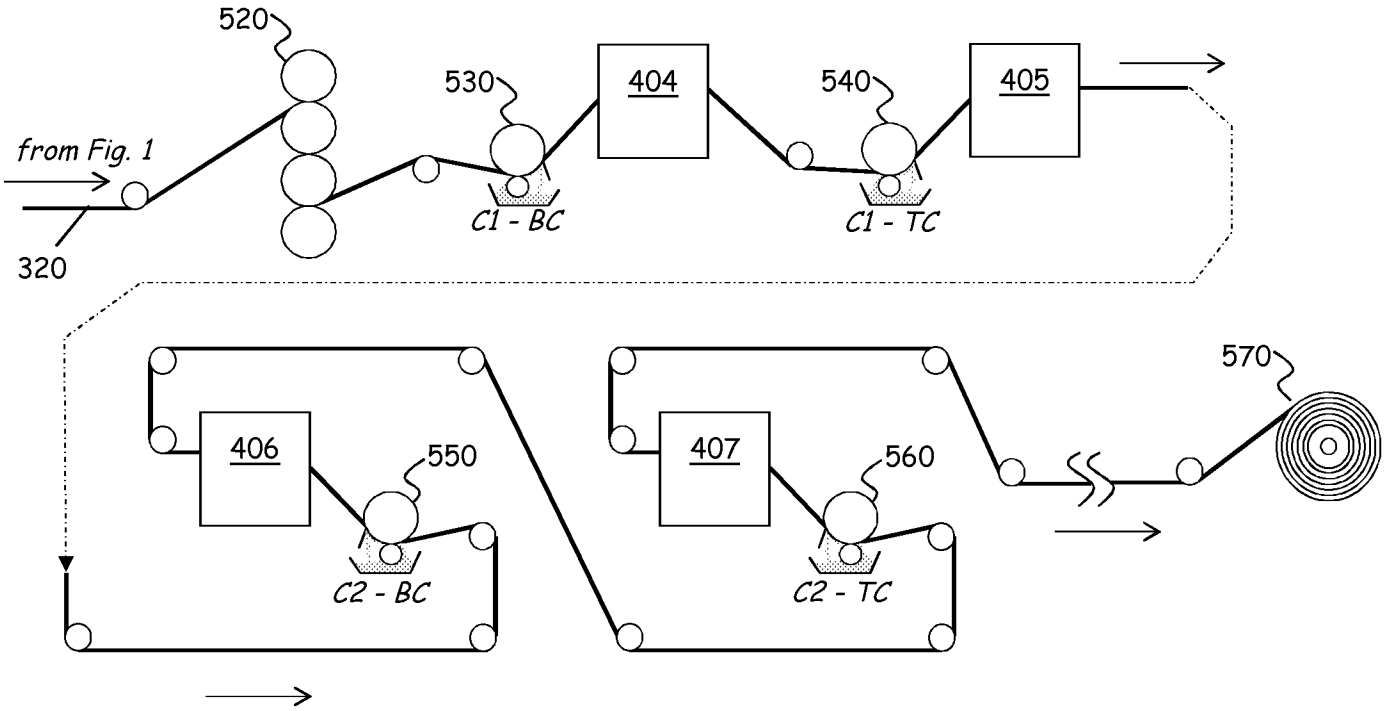
FIG. 2 illustrates a method for treating the base stock from FIG. 1 by applying coatings to both sides on a paperboard machine.

FIG. 1 and FIG. 2 illustrate an exemplary on-paper machine method for coating a paperboard web with two layers of aqueous coating. A forming wire 110 in the form of an endless belt passes over a breast roll 115 that rotates proximate to a headbox 120. The headbox provides a fiber slurry in water with a fairly low consistency (for example, about 0.5% solids) that passes onto the moving forming wire 110. During a first distance 230 water drains from the slurry and through the forming wire 110, forming a web 300 of wet fibers. The slurry during distance 130 may yet have a wet appearance as there is free water on its surface. At some point as drainage continues the free water may disappear from the surface, and over distance 231, water may continue to drain although the surface appears free from water.

Eventually the web is carried by a transfer felt or press felt through one or more pressing devices such as press rolls 130 that help to further dewatering the web, usually with the application of pressure, vacuum, and sometimes heat. After pressing, the still relatively wet web 300 is dried, for example using dryer or drying sections 401, 402 to produce a dry web ("raw stock") 310 which may then be run through a size press 510 that applies a surface sizing to produce a sized "base stock" 320 which may then be run through additional dryer sections 403 and (on FIG. 2) smoothing steps such as calendar 520.

The base stock 320 may then be run through one or more coaters. For example, coater 530 may apply a base coat ("BC") to a first side ("C1") of the web, and the base coating may be dried in one or more dryer sections 404. Coater 540 may apply a top coat ("TC") to the first side of the web, and the top coating may be dried in one or more dryer sections 405.

Figure 3:
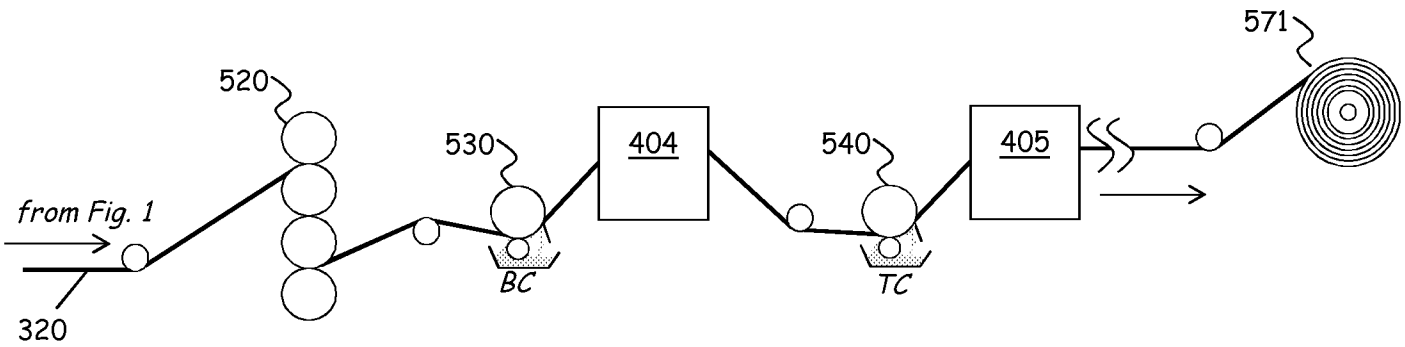
FIG. 3 illustrates a method for treating the base stock from FIG. 1 by applying coatings to one side on a paperboard machine.

If the web is to be coated on two sides, coater 550 may apply a base coat to the second side ("C2") of the web, and the base coating may be dried in one or more dryer sections 406. Coater 560 may apply a top coat to the second side of the web, and the top coating may be dried in one or more dryer sections 407. The order of coaters 540, 550 may be swapped, so that both sides C1 and C2 are first given a base coat, and then both sides are given a top coat. In some instances only one side will be coated as shown in FIG. 3, or only a base coat may be applied. In some instances a third coat may be applied to one side.

Figure 4:
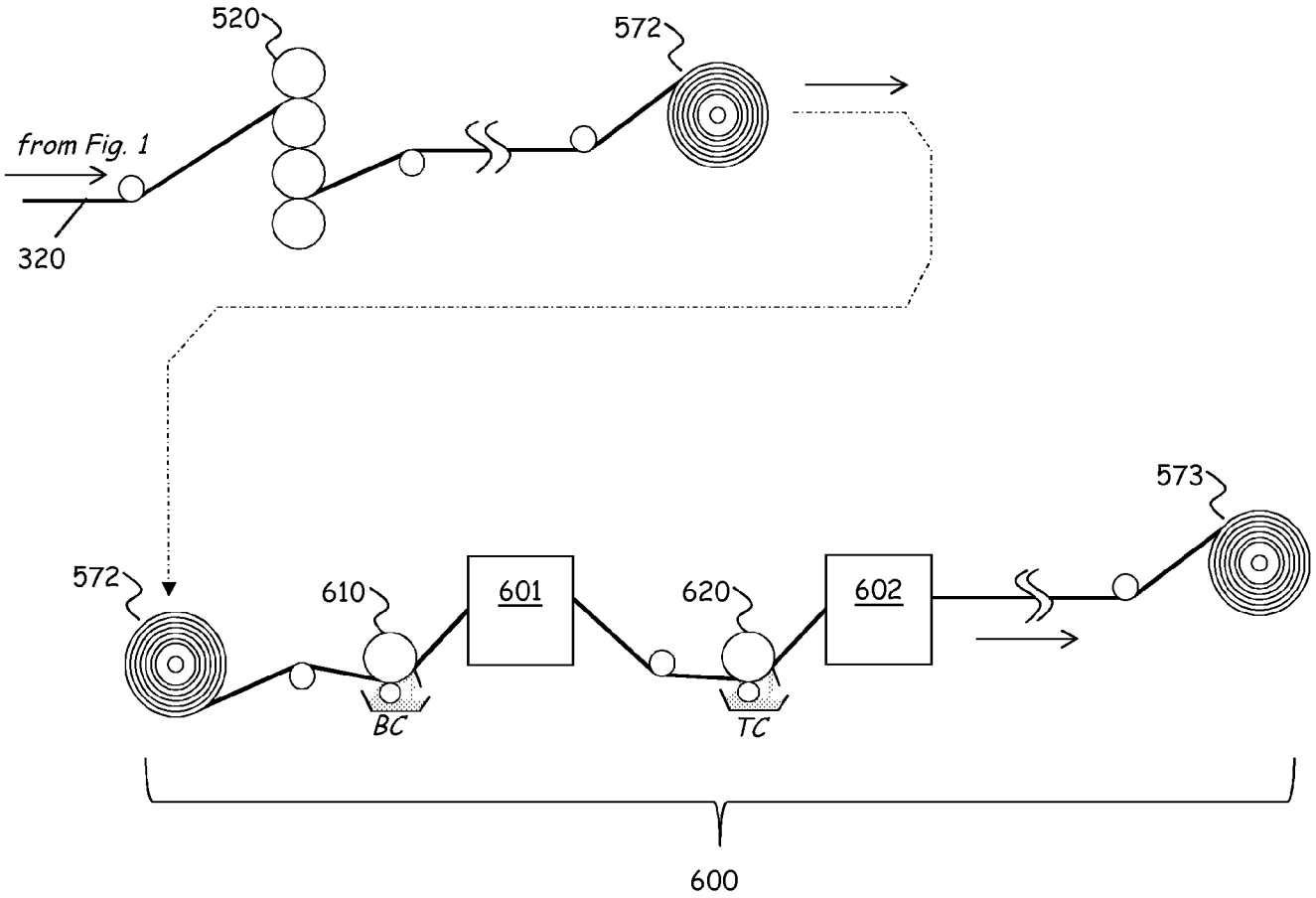
FIG. 4 illustrates a method for treating the base stock from FIG. 1 by applying coatings to one side on an off-machine coater.

Instead of applying coating by on-machine coaters as shown in FIGS. 2 and 3, coating may be applied by an off-machine coater as shown in FIG. 4. In such cases, the paperboard having been produced on the paper machine and wound onto reel 572 may then be transported (as a reel or as smaller rolls) to an off machine coater 600, where the paperboard is unwound from reel 572, given a base coating by coater 610, dried in dryer(s) 601, given an optional top coating by coater 620, dried in dryer(s) 602, optionally given further treatment (such as gloss calendaring) and then wound onto reel 573. An off machine coater could instead apply a single coat to one side of the paperboard, or could apply a single coat to each side, or could apply more than one coat to either or both sides. Alternately some coating may be done on the paper machine, with additional coating done on an off-machine coater.

Various types of coating devices may be used. The coaters illustrated in FIGS. 2-4 are devices where a coating is held in a pan, transferred by a roll to the lower surface of the web (which may be either the first side or the second side depending on the web path), and then the excess coating scraped off by a blade as the web wraps partially around a backing roll. However other coater types may be used instead, including but not limited to curtain coater, air knife coater, rod coater, film coater, short-dwell coater, spray coater, and metering film size press.

The particular materials used in the coatings may be selected according to the desired properties of the finished paperboard. For example one side e.g. C1 may be given coating(s) that provide desired printability, while the other side e.g. C2 may be given barrier coating(s) that provide oil and grease resistance (OGR). Depending on manufacturing preference, the printability coating may be applied before the OGR coating, or, the OGR coating may be applied before the printability coating.

Following the coaters, there may be additional equipment for further processing such as additional smoothening, for example gloss calendaring. Finally the web is tightly wound onto a reel 570.

The general process of papermaking and coating having been outlined at a high level in the preceding description and with FIGS. 1-4, we now turn to the barrier coatings of the present invention. Typical aqueous barrier coatings often use specialty polymer(s), wax, and/or a higher polymer binder level (compared to conventional print coatings), but these coatings can cause problems with repulpability of the coated paperboard because the coatings are usually difficult to breakdown to acceptable size or tend to form stickies' in paperboard making with the recycled fibers.

Furthermore, many barrier coatings give paperboard a tendency to 'block' (the layers stick together) either in the reel 570, 571, 572, 573 or after it is rewound into rolls. Particularly in the reel 570, there may be residual heat from the dryers, which may dissipate quite slowly because of the large mass of the reel. Higher temperatures may increase the tendency toward blocking.

It is known that paperboard coated with conventional printability coatings usually does not block, and usually is fully repulpable. It would be advantageous if not-blocking and fully repulpable coatings also provided barrier properties. However, conventional printability coatings do not provide satisfactory barrier properties. Their formulations have relatively low levels of binder so as to absorb rather than repel fluid (printing ink, for example).

Binder amounts in conventional printability coatings can range from 15-25 parts per 100 parts of pigment by weight for base coatings, and 10-20 parts per 100 parts pigment by weight for top coatings. Printing grades would tend to be in the lower half of these ranges. Limiting the binder amount in the top coating may allow printing inks or adhesives to absorb readily into the printability coating. Simply increasing the binder to improve barrier properties eventually interferes with printability and causes additional problems. Results of a control experiment are shown in Table 1, showing test results for a high-binder coating formulation AC-0 whose binder to pigment ratio is 100:100. The pigments Clay-1, $CaCO_3$-1, and SA (styrene acrylate copolymer) binder were the same materials (but not the same proportions) as used for tests shown later in Tables 4 and 5). Paperboard coated with a single coat of the high binder level coating showed good oil and grease resistance with a high 3M kit level of 11, but had only 97.2% fiber accepts in a repulping test. Also, blocking tests after 24 hours under 100 psi pressure were unacceptable. A blocking level of 4 resulted when the samples had been tested at 38° C./90% RH. In a later test of the same material, a blocking level of 2 resulted after the samples were held at 50° C. (unknown humidity). Blocking levels are explained later in Table 3; a value of zero is desired (no blocking), and higher values indicate increasingly worse blocking.

TABLE 1

Test Results for High-Binder Control

| AC-0 Control Coating | Coat Wt | 3M kit | Blocking | Repulpability |
|---|---|---|---|---|
| Clay-1/ $CaCO_3$-1/SA = 50/50/100 Binder/Pigment Ratio: 100/100 | 7.6 lb/ 3000 $ft^2$ | 11 | 4 | 97.2% |
| | | | 2 | |

Similar blocking and repulpability problems exist with many aqueous barrier coatings that use specialty polymer(s) and/or a higher polymer binder level (compared to printability coatings), with the deleterious effect that the coated paperboard is not completely recyclable and tends to block at elevated temperature or pressure.

In contrast, the inventive coatings disclosed in the present invention provide easy repulping along with good barrier properties, while using conventional polymer binders and conventional pigments that are low-cost and widely available as coating materials for the paper or paperboard industry. Conventional polymer binders may include, but are not limited to, styrene acrylate copolymer (SA) and styrene-butadiene copolymer (SB). Both styrene acrylate copolymer (SA) and styrene-butadiene copolymer (SB), or a blend of SA and SB, are used in examples described herein. The choice of SA or SB as a binder in the examples is not meant to be limiting in any way.

Conventional pigments are used in the present invention and may include, but are not limited to, kaolin clay, calcium carbonate, etc. Pigments used in the examples herein are given the following 'shorthand' designations:

"Clay-1" kaolin clay, for example, a No. 1 ultrafine clay

"Clay-2" platy clay with high aspect ratio

"$CaCO_3$-1" coarse ground calcium carbonate (particle size 60%<2 micron)

"$CaCO_3$-2" fine ground calcium carbonate (particle size 90%<2 micron).

In contrast to the high binder level of the AC-0 coating in Table 1, it has been discovered that applying multiple layers of coating using intermediate levels of binder (but greater than the binder levels used for printability coatings) can provide surprisingly good barrier properties along with excellent repulpability and no tendency toward blocking. The examples shown here use binder levels from 25 to 35 parts per 100 parts pigment by weight as shown by the example formulations in Table 2.

Barrier coatings according to the present invention were prepared according to the formulations shown in Table 2, which provides a list of major constituents in dry parts of the aqueous coating (AC) formulations used to achieve the surprisingly good oil and grease resistance, without blocking or repulpability problems (as reflected in Tables 3 and 4).

TABLE 2

Coating Formulations

| | AC1 | AC2 | AC3 | AC4 | AC5 |
|---|---|---|---|---|---|
| Clay-1 | 50 | 30 | 30 | | |
| Clay-2 | | | | 50 | |
| $CaCO_3$-1 | 50 | 45 | 45 | 25 | |
| $CaCO_3$-2 | | 25 | 25 | 25 | 100 |
| SA binder | 35 | 35 | 25 | 30 | 25 |
| Binder/pigment ratio | 35/100 | 35/100 | 25/100 | 30/100 | 25/100 |

Substantially no fluorochemical was used in the coatings. By "substantially no fluorochemicals" is meant that fluorochemicals were not deliberately utilized, and that any amount present would have been at most trace amounts. Although fluorochemicals can be excluded in lab experiments, trace amounts of such materials might be present in some paper machine systems due to making various grades of product, or might be introduced into a papermaking system through recycling processes. Likewise substantially no wax was used in the coatings.

The binder to pigment ratio (part of binder, by weight, to 100 parts of pigment) of the formulations shown in Table 2 ranges from 25 to 35. This is more than the binder to pigment ratio for typical printability coatings (where rapid absorption of ink is desired) and less than the binder to pigment ratio of typical barrier coatings. Thus it appears that an effective binder to pigment ratio may be from about 25 to about 40 parts binder per 100 parts pigment (by weight), or from 30 to 35 parts binder per 100 parts pigment. However, perhaps acceptable results (good 3M kit test, no blocking, and good repulpability) might be achieved with a slightly greater range.

Paperboard samples were made using solid bleached sulphate (SBS) substrate with a caliper of 16 pt ( 0.016"). The samples were coated on one side (herein termed the "barrier side") using a pilot blade coater with a one-layer or two-layer coating. The pilot results are expected to be representative of results that might be achieved on a production paper machine or a production off-machine coater.

The oil and grease resistance (OGR) of the samples was measured on the 'barrier side' by the 3M kit test (TAPPI Standard T 559 cm-02), with ratings from 1 (the least resistance to oil and grease) to 12 (excellent resistance to oil and grease penetration).

Figure 5:
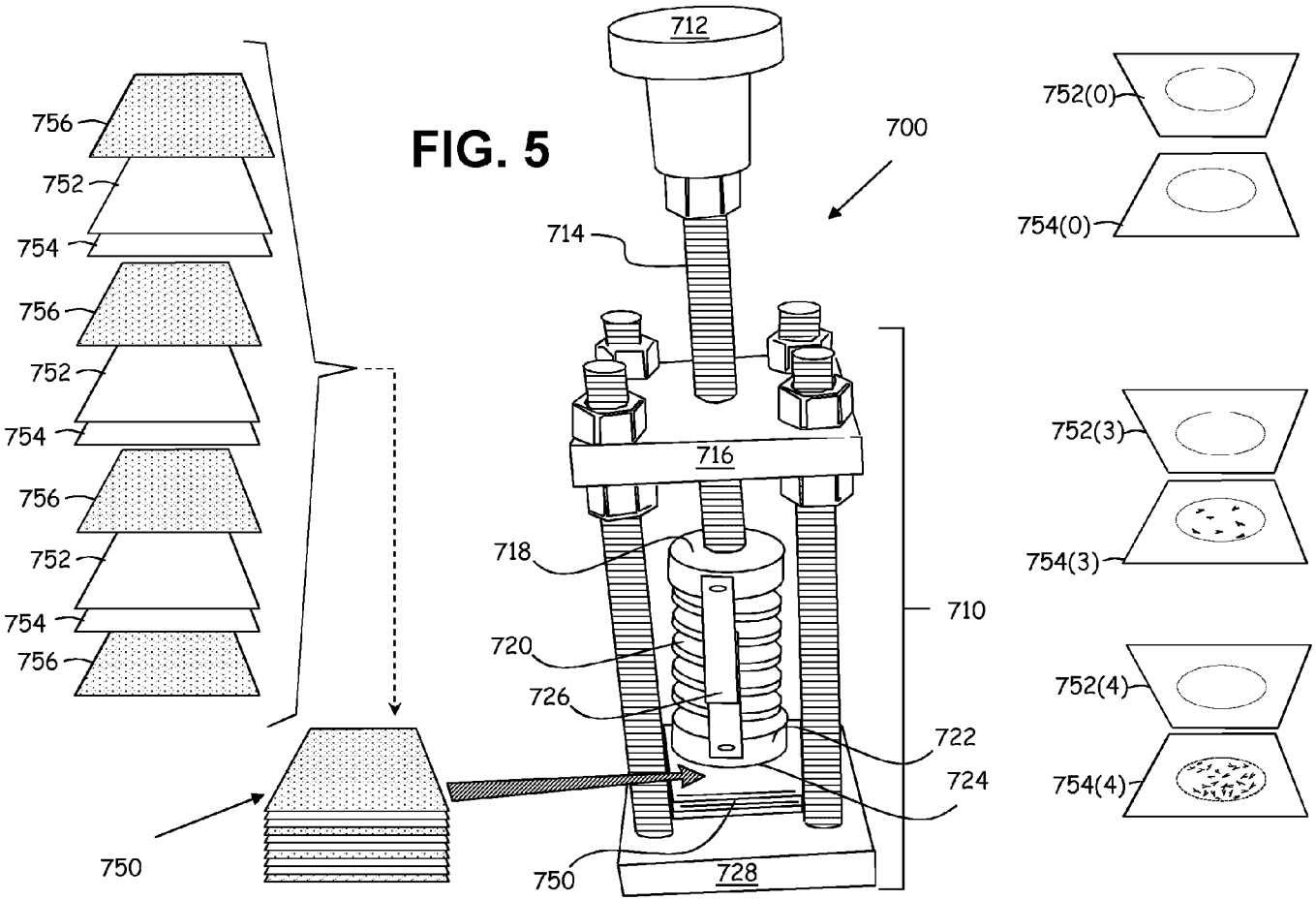
FIG. 5 illustrates a device for measuring blocking of paperboard.

The blocking behaviour of the samples was tested by evaluating the adhesion between the barrier coated side and the other uncoated side. A simplified illustration of the blocking test is shown in FIG. 5. The paperboard was cut into 2"×2" square samples. Several duplicates were tested for each condition, with each duplicate evaluating the blocking between a pair of samples 752, 754. (For example, if four duplicates were test, four pairs—eight pieces—would be used.) Each pair was positioned with the 'barrier-coated' side of one piece 752 contacting the uncoated side of the other piece 754. The pairs were placed into a stack 750 with a spacer 756 between adjacent pairs, the spacer being foil, release paper, or even copy paper. The entire sample stack was placed into the test device 700 illustrated in FIG. 5.

The test device 700 includes a frame 710. An adjustment knob 712 is attached to a screw 714 which is threaded through the frame top 716. The lower end of screw 714 is attached to a plate 718 which bears upon a heavy coil spring 720. The lower end of the spring 720 bears upon a plate 722 whose lower surface 724 has an area of one square inch. A scale 726 enables the user to read the applied force (which is equal to the pressure applied to the stack of samples through the one-square-inch lower surface 724).

The stack 750 of samples is placed between lower surface 724 and the frame bottom 728. The knob 712 is tightened until the scale 726 reads the desired force of 100 lbf (100 psi applied to the samples). The entire device 700 including samples is then placed in an environmental chamber at 38° C./90% RH for 24 hours or an oven at 50° C. for 24 hours. The device 700 is then removed from the test environment and cooled to room temperature. The pressure is then released and the samples removed from the device.

The samples were evaluated for tackiness and blocking by separating each pair of paperboard sheets. The results were reported as follows, with a 0 rating indicating no tendency to blocking:

TABLE 3

Blocking Ratings

0 = samples fall apart without any force applied

1 = samples have a light tackiness but separate without fiber tear

2 = samples have a high tackiness but separate without fiber tear

3 = samples are sticky and up to 25% fiber tear or coat damage (area basis)

4 = samples have more than 25% fiber tear or coat damage (area basis)

Blocking damage is visible as fiber tear, which if present usually occurs with fibers pulling up from the non-barrier surface of samples 754. If the non-barrier surface was coated with a print coating, then blocking might also be evinced by damage to the print coating.

For example in as symbolically depicted in FIG. 5, samples 752(0)/754(0) might be representative of a "0" blocking (no blocking). The circular shape in the samples indicates an approximate area that was under pressure, for instance about one square inch of the overall sample. Samples 752(3)/754(3) might be representative of a "3" blocking rating, with up to 25% fiber tear in the area that was under pressure, particularly in the uncoated surface of sample 754( 3). Samples 752(4)/754(4) might be representative of a "4" blocking rating with more than 25% fiber tear, particularly in the uncoated surface of sample 754(4). The depictions in FIG. 5 are only meant to approximately suggest the percent damage to such test samples, rather than showing a realistic appearance of the samples.

Repulpability was tested using an AMC Maelstom repulper. 110 grams of coated paperboard, cut into 1"×1" squares, was added to the repulper containing 2895 grams of water (pH of 6.5±0.5, 50° C.), soaked for 15 minutes, and then repulped for 30 minutes. 300 mL of the repulped slurry was then screened through a Vibrating Flat Screen ( 0.006" slot size). Rejects (caught by the screen) and fiber accepts were collected, dried and weighed.

The percentage of accepts was calculated based on the weights of accepts and rejects, with 100% being complete repulpability.

As an example of poor repulpability, SBS paperboard coated with low density polyethylene (LDPE) at a coat weight of 7-11 lbs per 3000 $ft^2$ was tested and gave fiber accepts in a range of 91 to 97%. (A fiber accepts percentage close to 100% is desired). Paperboard coated with polyethylene not easily repulpable and recyclable.

Various coating formulations shown in Table 2 were applied as a single layer onto a paperboard substrate, and the test results are shown in Table 3 including 3M kit Test, blocking, and repulpability. As seen in Table 4, paperboard coated with a single layer of coating does not block, is fully repulpable, and has a 3M kit level on the barrier side in the range of 5-10. However, with a single coat, even at the higher coat weights, the 3M kit test value never reached 11 or 12.

TABLE 4

Test Results with a Single Coat

| Test | AC1 | | | | AC2 | | | AC3 | | AC4 |
|---|---|---|---|---|---|---|---|---|---|---|
| Coat Weight lb/3000 $ft^2$ | 6.4 | 7.8 | 8.6 | 10.7 | 7.9 | | | 8.3 | | 7.9 |
| 3M kit | 7 | 5 | 7 | 7 | 6 | 9 | 8 | 10 | 6 | 7 |
| Blocking | 0 | 0 | — | 0 | 0 | 0 | — | 0 | — | 0 |
| Repulpability | — | 100% | — | — | — | 100% | — | 100% | — | 100% |

Next, the coating formulations shown in Table 2 were applied as two layers of coating onto the paperboard substrate. The results are shown in Table 5. Surprisingly good barrier properties are achieved in a paperboard product which is nonetheless completely repulpable and non-blocking. Either the same coating formulation or different coating formulations were used for the two layers of coating. Excellent oil and grease resistance with a 3M kit level of 12 is achieved when the paperboard is coated with a double-layer coating, either with the same formulation or with different formulations, even with a total coat weight of about 10 lbs per 3000 $ft^2$. The 3M kit level of 12 matches the polyethylene extrusion coated paperboard that is currently widely used in food and food service packaging. More importantly, the highly oil and grease resistant paperboard does not block and is completely repulpable.

The coated paperboard was also tested with vegetable oil (canola oil), on the barrier coated side for up to 24 hours. The results showed that for paperboard with a single coat, oil applied to the barrier coated side showed through on the opposite side after 24 hours. However, for paperboard with a double-layer coat, there was excellent oil holdout, and no oil staining or penetration visible on the opposite side. This confirmed the excellent oil grease resistance performance of the paperboard with a double-layer coat.

Thus, it has been found that coatings using conventional pigments with only intermediate levels of conventional binder, without typical barrier materials such as fluorochemicals or wax, gave excellent oil and grease resistance when applied as a double coat. Furthermore these results were achieved with no tendency toward blocking and with full repulpability of the paperboard.

Further testing was conducted to determine whether the moisture resistance, including water vapour barrier and liquid water barrier, of the inventive paperboard could be improved. The tests above utilized an SA (styrene-acrylic) binder. Tests were now run with combinations of SA (styrene acrylic) and SBR (styrene-butadiene rubber) binders. Results are given in Table 6. Within each test (e.g. Ctrl 1, Ctrl 2, A,B,C,D,E) the base coat (BC) and top coat (TC) used the same formulation (listed in the individual columns of the table). From test to test, the coating differed in the relative amounts of SA and SBR binder.

TABLE 5

Test Results with a Double Coat

| Test | AC1/AC1 | | AC2/AC2 | | AC3/AC3 | | AC4/AC4 | | AC1/AC5 |
|---|---|---|---|---|---|---|---|---|---|
| Coat Weight lb/3000 $ft^2$ | 7.8/6.1 | 6.4/6.3 | 7.9/5.2 | 6.5/3.3 | 7.5/5.6 | 6.8/3.4 | 7.9/5.0 | 6.6/4.1 | 7.6/7.5 |
| 3M kit | 12 | 12 | 12 | 12 | 12 | 12 | 12 | 12 | 12 |
| Blocking | 0 | 0 | 0 | — | 0 | 0 | 0 | 0 | 0 |
| Repulpability | 100% | — | 100% | — | 100% | 100 | 100% | — | 99.9% |

TABLE 6

Test Results with a Double Coat: Moisture Resistance

| Description | Ctrl 1 | A | B | C | D | E | Ctrl 2 |
|---|---|---|---|---|---|---|---|
| Clay-1 | 50 | 50 | 50 | 50 | 50 | 50 | 50 |
| $CaCO_3$-1 | 50 | 50 | 50 | 50 | 50 | 50 | 50 |
| SA (parts) | 35 | 17.5 | 13.5 | 10 | 10 | 10 | 0 |
| SBR (parts) | 0 | 17.5 | 21.5 | 25 | 25 | 25 | 35 |
| Binder/pigment ratio | 35/100 | 35/100 | 35/100 | 35/100 | 35/100 | 35/100 | 35/100 |
| BC/TC lb/3msf | 9.4/6.2 | 9.3/6.2 | 9.5/5.9 | 9.2/6.2 | 9.2/4.5 | 8.1/5.1 | 9.4/5/7 |
| 3M kit (1-12) | 11.6 | 11.6 | 12 | 12 | 12 | 12 | 11.8 |
| WVTR gsm/d | 634 | 370 | 387 | 327 | 377 | 367 | 265 |
| 2-min Cobb gsm | 26.7 | 19.7 | 16.5 | 13.8 | 14.5 | 15.8 | 10.8 |
| Repulp % accepts | 100 | 100 | 99.9 | 100 | 100 | 100 | 99.3 |

The control coatings were Control 1 ( 35 parts SA binder as used in several of the previous tests) and Control 2 ( 35 parts SBR binder). Control 1 had the highest/worst WVTR (water vapor transmission rate at 38° C. and 90% relative humidity; TAPPI Standard T 464 OM-12) and water Cobb (TAPPI Standard T 441 om-04)values. Control 2 had the lowest/best WVTR and Cobb values, but its repulpability of 99.3% was not as good.

With the mixtures of SA and SBR binders, good oil and grease resistance was obtained with 3M kit values of 11.6 and 12, and repulpability was excellent at 99.9-100%. The excellent oil/grease resistance or holdout of the barrier coated side was confirmed by a vegetable oil test, which (sample A and C tested) did not show any oil penetration or staining on the barrier coated surface within a testing period of 24 hours with canola oil. Water vapor transmission rate and two-minute Cobb were both improved (lower) compared to the use of SA binder alone. The samples showed no tendency to block.

The test coatings A-E incorporated mixtures of SA and SBR binders, with 35 total parts of binder including 10-25 parts of each binder. Specifically at least 10 of the 35 parts of binder (28.6%) were styrene acrylic binder, and at least 17.5 of the 35 parts of binder (50%) were styrene butadiene rubber. However, given the promising results obtained in Table 6, some improvement in moisture resistance might possibly occur with at least 25% or at least 20% SA, and with at least 40% or at least 35% SBR.

The tests described above used a blade coater to apply both the base coat and the top coat. As previously discussed, various types of coating devices may be used. Table 7 shows the test results of double coats by a metering (film) size press for the base coat and a blade coater for the top coat. Two different formulations, both similar to those discussed above, were used in the demonstration on a metering size press and a blade coater, respectively. Good oil and grease resistance was obtained with a 3M kit levels of 12 for the double coat by a metering size press and a blade coater. As a comparison, a single layer of the formulation AC-6 at a coat weight of 7.4 lbs per 3000 $ft^2$ by a metering size press only showed a 3M kit value of less than 1. The samples AC-6/AC-1 (7.4/7.9 lbs per 3000 $ft^2$) and AC-6/AC-7 (6.4/7.9 lbs per 3000 $ft^2$) were tested with canola oil on the double coated side for 24 hours, and both samples showed excellent oil holdout property of the double coat. The sample AC-6/AC-1 (7.4/7.9 per 3000 $ft^2$) did not show any oil penetration or staining on the double coat. The sample AC-6/AC-7 (6.4/7.9 per 3000 $ft^2$) only showed a few very faint surface staining spots (no penetration) on the barrier coated surface. The samples showed no tendency to block.

TABLE 7

Double Coat: Metering (Film) Size Press and Blade Coater

| Formulation | AC-6 (for metering size press) | AC-1 (for blade coater) | | AC-7 (for blade coater) (as C, D, E in Table 6) | |
|---|---|---|---|---|---|
| Clay-1 | 25 | 50 | | 50 | |
| Clay-2 | 40 | | | | |
| $CaCO_3$-1 | 35 | 50 | | 50 | |
| SA (parts) | 35 | 35 | | 10 | |
| SBR (parts) | 0 | 0 | | 25 | |
| Binder/pigment ratio | 35/100 | 35/100 | | 35/100 | |
| Coating layers | AC-6/none | AC-6/AC-1 | | AC-6/AC-7 | |
| BC/TC lb/3 msf | 7.4/0 | 7.4/5.3 | 7.4/7.9 | 6.4/6.3 | 6.4/7.9 |
| 3M kit (1-12) | <1 | 12 | 12 | 12 | 12 |
| WVTR gsm/d | — | 739 | 669 | 427 | 450 |
| Blocking | 0 | 0 | 0 | 0 | 0 |

Once given the above disclosure, many other features, modifications or improvements will become apparent to the skilled artisan. Such features, modifications or improvements are, therefore, considered to be a part of this invention, the scope of which is to be determined by the following claims.

While preferred embodiments of the invention have been described and illustrated, it should be apparent that many modifications to the embodiments and implementations of the invention can be made without departing from the spirit or scope of the invention. It is to be understood therefore that the invention is not limited to the particular embodiments disclosed (or apparent from the disclosure) herein, but only limited by the claims appended hereto.

The invention claimed is:

1. A coated paperboard, comprising:

a paperboard substrate having a first side and a second side;

a base coat in contact with the first side, the base coat comprising binder and pigment, the base coat containing substantially no fluorochemical or wax;

a top coat in contact with the base coat, the top coat comprising binder and pigment, the top coat containing substantially no fluorochemical or wax;

wherein the coated paperboard has a 3M kit test value of at least 10; and wherein the coated paperboard is repulpable to the extent that after repulping the percentage accepts is at least 99%.

2. The coated paperboard of claim 1, wherein the 3M kit test value is 12.

3. The coated paperboard of claim 1, wherein the percentage accepts is at least 99.9%.

4. The coated paperboard of claim 1, wherein the base coat weight is 5 to 12 lbs per 3000 $ft^2$.

5. The coated paperboard of claim 1, wherein the top coat weight is 2 to 9 lbs per 3000 $ft^2$.

6. The coated paperboard of claim 1, having no tendency toward blocking after being held for 24 hours at 50° C. at a pressure of 100 psi.

7. The coated paperboard of claim 1, wherein the binder to pigment ratio in the base coat is between 25 to 40 parts binder per 100 parts pigment, by weight.

8. The coated paperboard of claim 1, wherein the binder to pigment ratio in the top coat is between 25 to 40 parts binder per 100 parts pigment, by weight.

9. The coated paperboard of claim 1, wherein the binder comprises at least one of styrene acrylate copolymer and styrene-butadiene copolymer.

10. The coated paperboard of claim 1, wherein the pigment comprises at least one of a clay and calcium carbonate.

11. The coated paperboard of claim 1, wherein the pigment comprises a No. 1 ultrafine kaolin clay.

12. The coated paperboard of claim 1, wherein the pigment comprises a high aspect ratio platy clay.

13. The coated paperboard of claim 1, wherein the pigment comprises at least one of a coarse ground calcium carbonate and a fine ground calcium carbonate.

14. The coated paperboard of claim 1, wherein the coated paperboard has a water vapor transmission rate of at most 425 grams per square meter per day at 38° C. and 90% relative humidity.

15. The coated paperboard of claim 1, wherein the coated paperboard has a two-minute Cobb test of at most 20 grams per square meter.

16. The coated paperboard of claim 1, wherein the binder comprises both styrene acrylate copolymer (SA) and styrene-butadiene copolymer (SBR).

17. The coated paperboard of claim 16, wherein the binder comprises at least 20% SA and at least 35% SBR.

18. A coated paperboard comprising:

a paperboard substrate having a first side and a second side;

a base coat in contact with the first side, the base coat having a coat weight from 5 to 12 lbs per 3000 $ft^2$ and comprising binder and pigment , the base coat containing substantially no fluorochemical or wax;

a top coat in contact with the base coat, the top coat having a coat weight from 2 to 9 lbs per 3000 $ft^2$ and comprising binder and pigment, the top coat containing substantially no fluorochemical or wax;

wherein the coated paperboard has a 3M Kit test value of at least 10, is at least 99% repulpable, and has no tendency toward blocking after being held for 24 hours at 50° C. at a pressure of 100 psi.

19. The coated paperboard of claim 18, wherein the base coat weight is 6 to 9 lbs per 3000 $ft^2$.

20. The coated paperboard of claim 18, wherein the top coat weight is 3 to 6 lbs per 3000 $ft^2$.

21. A method of treating paperboard, the method comprising:

providing a paperboard substrate having a first side and a second side;

applying to the first side a base coat comprising binder and pigment, and containing substantially no fluorochemical or wax;

applying over the base coat a top coat comprising binder and pigment, the top coat containing substantially no fluorochemical or wax;

wherein the resulting treated paperboard has a 3M kit test value of at least 10; and wherein the coated paperboard is repulpable to the extent that after repulping the percentage accepts is at least 99%.

22. The method of claim 21, wherein the base coat is applied by a device selected from the group consisting of a blade coater, curtain coater, air knife coater, rod coater, film coater, short-dwell coater, spray coater, and metering film size press.

23. The method of claim 21, wherein the top coat is applied by a device selected from the group consisting of a blade coater, curtain coater, air knife coater, rod coater, film coater, short-dwell coater, spray coater, and metering film size press.

* * * * *